US005167544A

United States Patent [19]

Brinkman et al.

[11] Patent Number: 5,167,544

[45] Date of Patent: Dec. 1, 1992

[54] FEMALE ELECTRICAL CONTACT

[75] Inventors: Donald J. Brinkman, Woodridge; Frank A. Harwath, Downers Grove, both of Ill.; Richard A. Johnson, Poughkeepsie, N.Y.; Glenn A. Landgraf, Naperville, Ill.; Howell B. Schwartz, Poughkeepsie, N.Y.

[73] Assignee: Molex Incorporated, Lisle, Ill.

[21] Appl. No.: 791,867

[22] Filed: Nov. 13, 1991

[51] Int. Cl.[5] ..... H01R 11/22

[52] U.S. Cl. ..... 439/856; 439/842

[58] Field of Search ..... 439/842–845, 439/851–857, 861, 862

[56] References Cited

U.S. PATENT DOCUMENTS

| | | | |
|---|---|---|---|
| 3,363,224 | 1/1968 | Gluntz | 439/852 |
| 4,076,369 | 2/1978 | Ostapovitch | 339/258 R |
| 4,175,821 | 11/1979 | Hunter | 439/856 |
| 4,232,931 | 11/1980 | Takeuchi et al. | 439/857 |
| 4,331,376 | 5/1982 | Leather | 439/857 |
| 4,591,230 | 5/1986 | Roldan | 439/856 |
| 4,607,907 | 12/1986 | Bogursky | 339/258 P |
| 4,679,890 | 7/1987 | Fineblum | 439/884 |
| 4,708,416 | 11/1987 | Awano et al. | 439/851 |
| 4,784,622 | 11/1988 | Senor | 439/853 |
| 4,941,853 | 7/1990 | Harwath | 439/848 |
| 4,952,178 | 8/1990 | Beer | 439/856 |
| 4,973,273 | 11/1990 | DePriest | 439/856 |
| 5,035,658 | 7/1991 | Berg | 439/748 |

FOREIGN PATENT DOCUMENTS

| | | | |
|---|---|---|---|
| 2529023 | 12/1983 | France | 439/851 |
| 1435587 | 5/1976 | United Kingdom | 439/851 |

*Primary Examiner*—David L. Pirlot
*Attorney, Agent, or Firm*—Charles S. Cohen

[57] ABSTRACT

A female electrical contact is disclosed to include an elongate body having a terminal portion at one end and a receptacle portion at the other end for receiving a complementary male pin. A pair of cantilevered arms are provided of substantially equal length and in opposed relationship to each other with contact portions at their distal ends. The cantilevered arms are axially offset from each other in the longitudinal direction of insertion of the complementary male pin, whereby the male pin engages the contact portions sequentially. The cantilevered arms are bowed inwardly so that the contacted portion of one of the arms engages the other arm under a preload.

4 Claims, 1 Drawing Sheet

FEMALE ELECTRICAL CONTACT

FIELD OF THE INVENTION

This invention generally relates to the art of electrical connectors and, particularly, to a female electrical contact for receiving a complementary male terminal in an electrical connector system.

BACKGROUND OF THE INVENTION

In the ever increasing miniaturization of electronic circuitry , it has become increasingly difficult to fabricate separable electrical contacts that are as reliable and as durable as the larger components which they replace. In high density or miniaturized systems, as many as 96 pairs of contacts may be disposed in less than 0.5 inch square of area. Yet, the electrical contacts must have sufficient contact force to ensure reliable electrical connections with the complimentary male terminals. In turn, the terminals themselves are very small and, consequently, the electrical contacts must allow easy insertion and withdrawal of the terminals.

A common type of female or receptacle electrical contact for connecting to the terminals of electrical connectors in such environments as described above, includes at least a pair of contact blades or spring arms extending in cantilevered fashion longitudinally within the contact. The cantilevered spring arms have distal ends providing contact portions for engagement by the terminals of the electrical connectors, with the proximal ends of the cantilevered arms being rigid with a body portion of the contacts. Examples of such cantilevered arm contacts are shown in U.S. Pat. No. 4,076,369 to Ostapovitch, dated Feb. 28, 1978; U.S. Pat. No. 4,607,907 to Bogursky, dated Aug. 26, 1986; and U.S. Pat. No. 4,784,622 to Senor, dated Nov. 15, 1988.

This invention is directed to improvements in cantilevered arm type female contacts of the character described above.

SUMMARY OF THE INVENTION

An object, therefore, of the invention is to provide a new and improved female electrical contact for receiving a complementary male pin.

In the exemplary embodiment of the invention, generally, the female contact or receptacle includes an elongate body having a terminal portion at one end and a receptacle portion at the other end. The receptacle portion provides means for receiving a complementary male pin and includes a pair of cantilevered arms. The arms are of substantially equal length and in opposed relationship to each other with contact portions at their distal ends. The cantilevered arms are axially offset from each other in the longitudinal direction of insertion of the complementary male pin whereby the male pin engages the contact portions sequentially. The female contact is fabricated as a unitary stamped and formed metal component. The cantilevered arms project at their proximal ends from base portions rigid with the elongated body, the base portions being spaced transversely of the body wider than the contact portions. Preferably, the cantilevered arms are bowed, with the contact portion of the arms preloaded against each other so that they contact each other.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
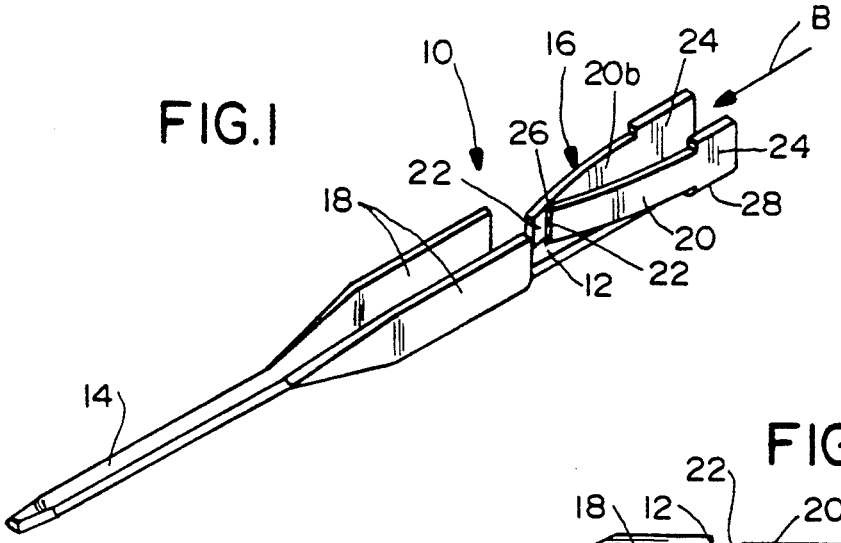
FIG. 1 is a perspective view of a female electrical contact embodying the concepts of the invention.

Referring to the drawings in greater detail, and first to FIG. 1, the invention is embodied in a female electrical contact or receptacle, generally designated 10, which includes an elongate body 12 having a terminal portion or solder pin 14 at one end and a female or receptacle portion, generally designated 16, at the other end. The terminal is unitarily fabricated of extremely thin stamped and formed metal material, such as from 0.004 inch metal stock. Solder tail 14 has a generally U-shaped cross-section for rigidifying purposes. Body 12, itself, is provided with supporting walls 18 intermediate its ends to form a larger U-shaped cross-section. Although the exemplary embodiment shows terminal portion 14 as a solder tail for insertion through a hole in a printed circuit board, it should be understood that the terminal portion of female electrical contact 10 can be of a variety of configurations, including terminal means for surface mounting or interconnection to other electrical circuit means.

Receptacle portion 16, generally, provides means for receiving a complementary male pin, as described in greater detail hereinafter, which would comprise the lead of an appropriate mating electrical component.

Specifically, receptacle portion 16 includes a pair of cantilevered arms **20*a* and 20*b* of substantially equal length and in opposed relationship to each other, as shown. Each cantilevered arm has a contact portion 22 at its distal end, with the proximal ends of the arms being integral with base portions 24 formed integral with body 12** to be rigid therewith.

With cantilevered arms **20*a* and 20*b* being of substantially equal length, the invention contemplates that the arms are axially offset from each other in the longitudinal direction of insertion of the complementary male pin, as indicated by arrow "B", whereby the male pin engages the contact portions 22 sequentially. To this end, it can be seen that base portion 24*a* of cantilevered arm 20*a* is shorter, in the longitudinal direction of the terminal, than base portion 24*a* of cantilevered arm 20*b*. Therefore, as the complementary male pin is inserted between base portions 24*a* and 24*b* into receptacle portion 16, the male pin will engage contact portion 22 of cantilevered arm 20***a* before the male pin engages contact portion 22 of cantilevered arm 20*b*. Base portions 24*a* and 24*b* are spaced transversely of the terminal substantially the same as the spacing of supporting walls 18, although such an alignment is not required, with cantilevered arms 20*a* and 20*b* being bent inwardly. Preferably, the cantilevered arms are bent in a uniform bow, as shown, with generally equal radii.

Figure 2:
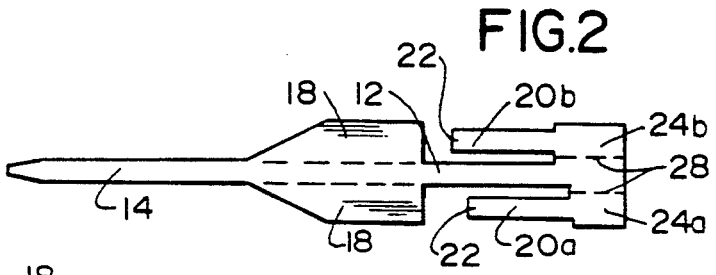
FIG. 2 is a plan view of a blank from which the terminal is fabricated.
Figure 3:
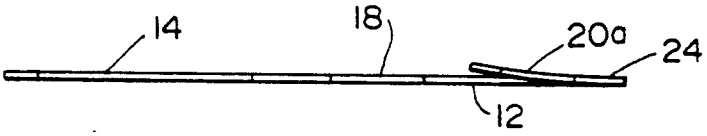
FIG. 3 is an edge elevational view illustrating how the cantilevered arms are formed from the blank in a bowed configuration prior to forming the terminal as shown in FIG. 1.

It can be seen in FIG. 1 that contact portion 22 of cantilevered arm 20*a* engages the inside of cantilevered arm 20*b*, at a point 26, spaced from contact portion 22 of cantilevered arm 20*b* in the direction of the insertion end of the terminal. The invention contemplates that this engagement be under a preload. To that end, FIG. 2 shows a blank from which female electrical contact 10 is formed. As stated above, the blank would be formed from thin metal stock, such as of 0.004 inch thickness. Before the terminal is formed into the ultimate shape shown in FIG. 1, cantilevered arms 20*a* and 20*b* are formed into their bow as shown in FIG. 3. Then, when the cantilevered arms and base portions 24 are formed at generally right-angles to body portion 12, as at fold lines 28 (FIG. 1), contact portion 22 of cantilevered arm 20*a* will engage cantilevered arm 20*b*, at point 26, under a preload which is determined by the amount of bow formed into the arms as indicated in FIG. 3. Such preload improves manufacturability and ensures adequate contact between both arms 20*a* and 20*b* and a male pin inserted therein even if the pin is off-center.

Figure 4:
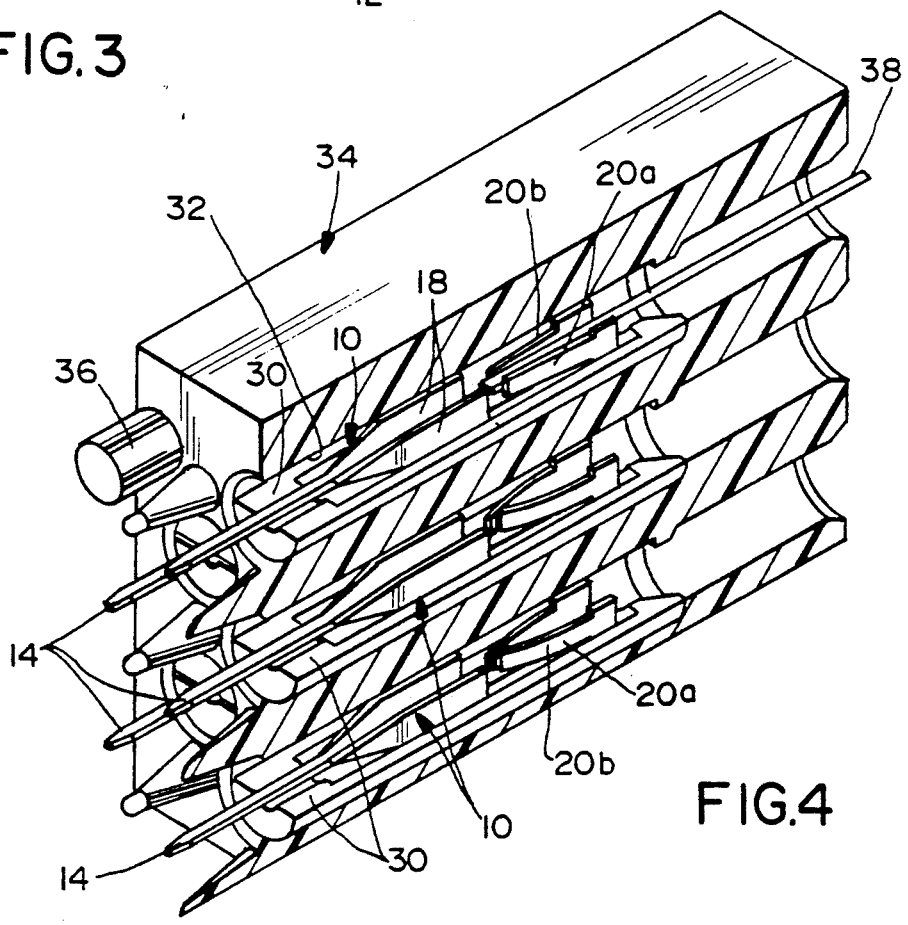
FIG. 4 is a perspective view of a plurality of the terminals mounted in a representative connector housing.

FIG. 4 simply shows a plurality of female electrical contacts 10 disposed in insulators 30 which, in turn, are mounted in bores 32, of a connector housing, generally designated 34. The housing is designed for mounting to a printed circuit board, with standoffs 36 spacing the housing from the printed circuit board. It can be seen that terminal portions or solder tails 14 of the terminals project beyond standoffs 36 for insertion into holes in an appropriate printed circuit board for connection to appropriate circuit traces around or within the holes in the board. The tail portions could, however, alternatively be surface mounted to the circuit board.

FIG. 4 also shows a complementary male pin 38 having a diameter of approximately 0.01 inches inserted into the top female terminal 10, spreading cantilevered arms 20*a* and 20*b*, with the contact portions 22 of the arms engaging the complementary male pin. As stated above, during insertion, the male pin first will engage contact portion 22 at the distal end of cantilevered arm 20*a* and then, sequentially, engage contact portion 22 at the distal end of cantilevered arm 20*b*. The arms are under a predetermined preload, as described above, and, with the cantilevered arms being of substantially equal length, equal engagement pressure will be applied by the arms in opposing directions on opposite sides of the complementary male pin.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A female electrical contact for mating with a complementary male pin from only one direction, said contact comprising:

a generally planar elongate body having a terminal portion at one end for electrical and mechanical termination to circuit board and a receptacle portion adjacent the other end;

the receptacle portion providing means for receiving said complementary male pin and including a pair of base portions rigid with and spaced transversely of the body, said base portions extending generally perpendicularly from said body at an end of said body opposite said terminal portion and including generally abrupt end surfaces at the top thereof;

said receptacle further including a pair of cantilevered arms of substantially equal length and in opposed relationship to each other with contact portions at their distal ends and each extending from one of said base portions towards said terminal portion, the cantilevered arms being bowed with their distal ends disposed inwardly of their proximal ends and the end of one arm being preloaded against the other arm, and the cantilevered arms being axially offset from each other in the longitudinal direction of insertion of the complementary male pin whereby the male pin engages the contact portions sequentially; and said body further including a second pair of upstanding walls rigid with and spaced transversely of the body, said second pair of walls extending generally perpendicularly from said body and including generally abrupt end surfaces at the top thereof, said second pair of walls being positioned between said receptacle and said terminal portion;

whereby said female contact is dimensioned such that said cantilevered arms are positioned between a pair of generally U-shaped portions of said contact in order to rigidify said contact within an insulator.

2. The female electrical contact of claim 1 wherein one of said U-shaped portions includes said base portions and the other of said U-shaped portions includes said upstanding walls.

3. The female electrical contact of claim 2 wherein said contact is stamped and formed from sheet metal material approximately 0.004 inches thick.

4. The female electrical contact of claim 2 wherein said terminal portion is an elongated solder tail having a generally U-shaped cross-section.

* * * * *

UNITED STATES PATENT AND TRADEMARK OFFICE

CERTIFICATE OF CORRECTION

PATENT NO. : 5,167,544
DATED : December 1, 1992
INVENTOR(S) : Donald J. Brinkman, et. al.

It is certified that error appears in the above-indentified patent and that said Letters Patent is hereby corrected as shown below:

Title page, item [73], Assignee: should read--Molex Incorporated, Lisle, Ill., International Business Machines, Poughkeepsie, Ny--.

Signed and Sealed this

Thirteenth Day of December, 1994

*Attest:*

Bruce Lehman

BRUCE LEHMAN

*Attesting Officer*

*Commissioner of Patents and Trademarks*